United States Patent [19]

Francis

[11] Patent Number: 4,944,511

[45] Date of Patent: Jul. 31, 1990

[54] ADJUSTABLE RESILIENT REEL EXERCISER

[75] Inventor: Paul S. Francis, 4603 Homestead Dr., Prairie Village, Kans. 66208

[73] Assignee: Paul S. Francis, Prairie Village, Kans.

[21] Appl. No.: 300,563

[22] Filed: Jan. 23, 1989

[51] Int. Cl.[5] ..... A63B 21/02

[52] U.S. Cl. ..... 272/137; 272/72; 272/135

[58] Field of Search ..... 272/72, 116, 119, 133, 272/134, 135, 137, 138, 139, 140, 143, 146, DIG. 4

[56] References Cited

U.S. PATENT DOCUMENTS

| | | | |
|---|---|---|---|
| 481,730 | 8/1892 | Miller | 272/136 |
| 760,374 | 5/1904 | Belvoir | 272/136 |
| 1,139,126 | 5/1915 | Kerns | 272/140 |
| 1,324,404 | 12/1919 | Metzger | 272/140 |
| 1,867,642 | 7/1932 | Woods | 272/137 |
| 1,954,762 | 4/1934 | Wolff | 272/140 |
| 2,512,911 | 6/1950 | Benice . | |
| 3,441,271 | 4/1969 | Palacios | 272/146 X |
| 3,544,105 | 12/1970 | Latta . | |
| 3,610,617 | 10/1971 | Hepburn . | |
| 3,690,654 | 9/1972 | Hepburn . | |
| 3,764,132 | 10/1973 | Hepburn . | |
| 3,885,789 | 5/1975 | Deluty et al. . | |
| 3,995,853 | 12/1976 | Deluty . | |
| 4,077,626 | 3/1978 | Newman . | |
| 4,195,835 | 4/1980 | Hinds et al. | 272/143 X |
| 4,478,413 | 10/1984 | Siwula | 272/134 |
| 4,557,480 | 12/1985 | Dudley . | |
| 4,645,204 | 2/1987 | Berger | 272/137 |
| 4,647,035 | 3/1987 | Yellen . | |
| 4,709,918 | 12/1987 | Grinblat . | |
| 4,822,039 | 4/1989 | Gonzales | 272/146 |

*Primary Examiner*—Richard J. Apley
*Assistant Examiner*—H. N. Flaxman
*Attorney, Agent, or Firm*—Kokjer, Kircher, Bradley, Wharton, Bowman & Johnson

[57] ABSTRACT

A portable exercise device which provides the benefits of working out with free weights. Adjustable foot pads on opposite sides of a central housing accommodate different stance widths and retract to a compact storage position. Right and left reels in the housing receive cords which extend through the foot pads and carry special hand grips. Outward pulling on the cords is resisted by spring packs having clock-type coil springs. The spring packs can be stacked on one another to vary the resistive force applied to the reels. The two resistance systems are independent of one another but are adjusted to the same initial tension by a common cable adjustment mechanism. Attachment of added components allows rowing exercises to be carried out.

21 Claims, 5 Drawing Sheets

ADJUSTABLE RESILIENT REEL EXERCISER

FIELD OF THE INVENTION

This invention relates generally to exercise equipment and more particularly to a portable exercise device that is constructed for use primarily in the conditioning of the upper body, including the arms, shoulders, back and chest.

BACKGROUND OF THE INVENTION

Physical conditioning through regular exercise has long been considered important in achieving and maintaining good overall health. The types of exercise equipment that have been available range from large stationary machines costing thousand of dollars to smaller and simpler items such as jump ropes and small weights. It is generally recognized that building and toning of the muscles in the upper body is effectively achieved by work with free weights. Typically, free weight workouts involve the use of barbells of various sizes.

Although work with free weights is highly popular, it is subject to a number of inherent problems. First, because of the need for different weights for different people and even for different exercises by the same person, a large number of weights are required, and this leads to high costs, storage difficulties and other problems. Safety is a serious problem associated with the use of heavy weights, and injuries are unfortunately rather commonplace. Finally, barbells are normally suitable for use only at home or at an exercise facility because of the difficulty of carrying them from place to place. Thus, free weights are not often used in workouts conducted in offices or during out of town travel.

Various types of exercise machines have been developed, but they are for the most part large stationary devices that are useful only at one location. Resistive force is usually provided by a brake or other friction device that is effective only in one direction. For example, brake resistance devices offer resistance only when a rope is pulled or extended, and the rope retracts freely without offering significant resistance. This is a serious drawback in that physiologists and other fitness experts recognize that muscle development is greatly enhanced if near equal resistance is provided both during extension and retraction (or raising and lowering). Existing devices are further characterized by difficulty in adjusting the resistive force, if it is adjustable at all, and by undue limitations on the range of resistance.

SUMMARY OF THE INVENTION

The present invention is directed to an improved exercise device and has, as its principal goal, the provision of a portable exercise device that offers substantially the same benefits as free weight workouts without the drawbacks and problems associated with barbells and other conventional weights.

In accordance with the invention, a portable base includes a central housing and a pair of foot pads that can be retracted against the housing for compact storage or easily extended to various positions to accommodate different stance widths. The adjustability of the foot pads permits the device to be conveniently and properly used by persons of various heights and weights.

The housing located between the foot pads contains two independent but identical resistive systems, one for each side of the body. Each resistance mechanism includes a spring loaded reel around which a cord is wound. The cords extend through the foot pads and are drawn around pulleys. The end of each cord is equipped with a hand grip which is specially constructed to readily accommodate virtually any wrist or arm movement that occurs during workouts. Forked cradles are provided for the hand grips, and the hand grips are securely gripped and held in place on the cradles when not in use.

Unwinding of each cord from its take up reel is resisted by a built-in spring pack having a coiled clock-type spring. The spring pack is arranged to apply spring force which opposes turning of the reel when the cord is pulled.

It is a special feature of the invention that additional spring packs can be stacked on top of one another to increase the resistance by adding to the spring force that must be overcome when the cord is pulled. The spring of each additional spring pack is in a neutral state when the spring pack is first stacked on the unit. The resistance is created by the rotation of the spring pack housing which causes the outer coils to move to the rim, thus leaving fewer coils to absorb the rotational force of the reel.

It is another important feature of the invention that the two resistance systems are independent of one another, thus allowing one arm or one side of the body to perform exercises independently of the other arm or side of the body.

Another important feature of the invention is the provision of a simple and easy to use adjustment of the spring force. This tension adjustment mechanism includes a spool which is connected with one of the spring packs and which receives a rope carrying a knob on its end. The rope can be pulled and locked against retraction by a toothed cleat, and this causes the spring to be placed under variable initial tension which depends upon the extent to which the rope is extended. The two spring packs are connected by a gear train so that they are adjusted simultaneously and to the same extent by the adjustment mechanism.

The exercise device can be used as a rowing machine which improves aerobic conditioning and conditioning of all of the major muscle groups. Removable rollers and foot straps can be installed on the foot pads as accessory items, and a special rowing bar can be connected to the two lines in place of the hand grips. The user can then sit on the floor and carry out rowing exercises with the rollers allowing the unit to roll away from and toward the user as the legs are extended and retracted.

It is a particularly important aspect of the invention that all of the foregoing features are exhibited by the device even though it is small enough and light enough to be easily carried in a brief case, suitcase or bag. The device is about the size of a conventional bathroom scale, and it is constructed of lightweight components to keep the overall weight as low as possible. Consequently, it can easily be carried back and forth to the office for use both there and at home, and it can likewise be taken along on out of town trips for quick and convenient, yet effective, workouts. At the same time, the weight and safety problems inherently associated with free weights are avoided, and the simple and compact construction of the unit results in a relatively low manufacturing cost.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 2:
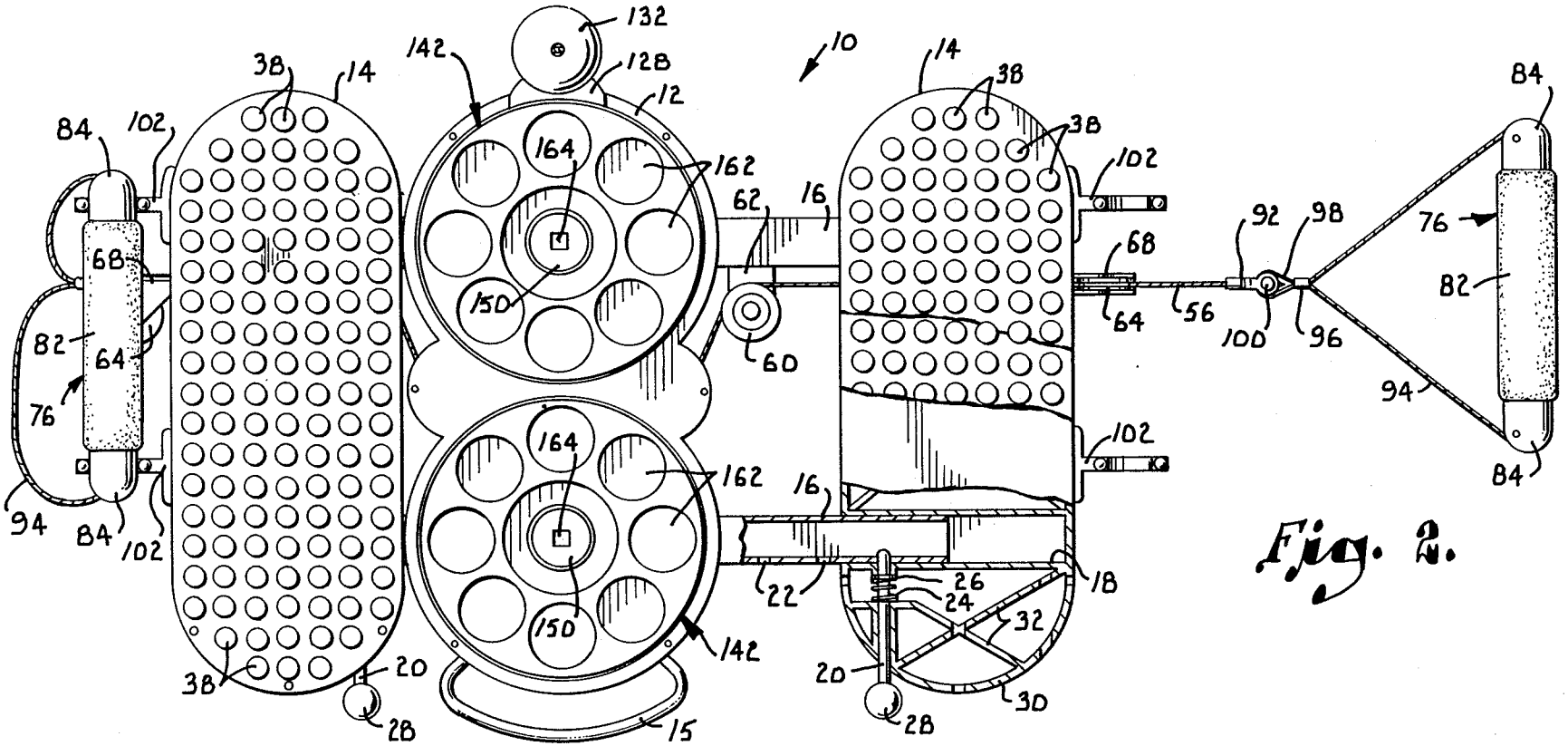
FIG. 2 is a top plan view of the exercise device, with portions broken away for purposes of illustration.
Figure 5:
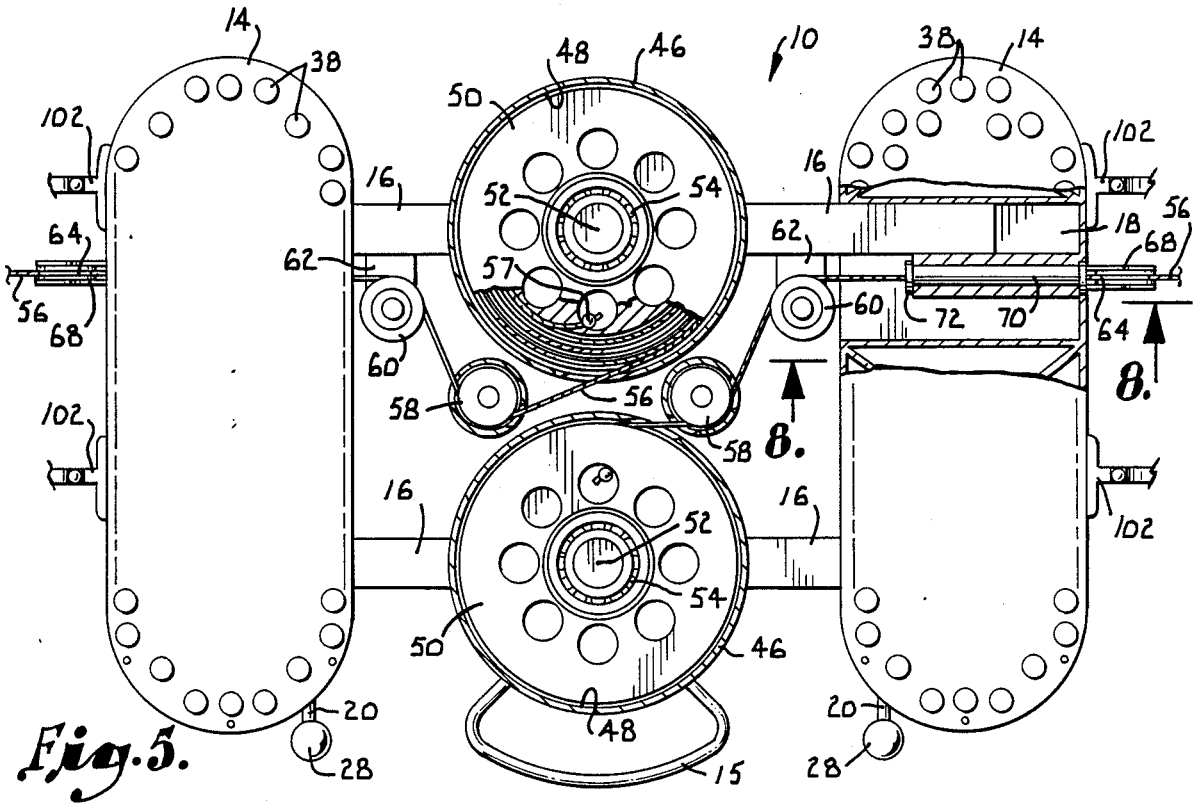
FIG. 5 is a fragmentary sectional view taken generally along line 5—5 of FIG. 3 in the direction of the arrows, with portions broken away for purposes of illustration.

Referring now to the drawings in more detail, numeral 10 generally designates a portable exercise device constructed in accordance with the present invention. The exercise device has a floor supported base which includes a central housing 12 and a pair of substantially identical foot pads 14 located on opposite sides of the housing 12. A handle 15 is provided on the back end of the housing 12. Each of the foot pads 14 is supported for sliding movement toward and away from the housing 12 and slides in and out along a pair of guide bars 16 which project from opposite sides of the housing 12. As best shown in FIGS. 2 and 5, each foot pad 14 has a pair of transverse passages 18 which closely receive the guide bars 16. The passages 18 are parallel to one another and are located near the front and back ends of each foot pad 14. Each foot pad 14 is equipped with a spring loaded latching pin 20 which normally projects into one of the passages 18 and is received in one of a plurality of small openings 22 (see FIG. 2) formed in guide bar 16. A compression spring 24 is coiled around each pin 20. Each spring 24 acts at its front end against an enlarged collar 26 on the pin 20 in order to continuously urge pin 20 in a direction to extend through the openings 22. The back or outer end of each of pin 20 is provided with a ball shaped knob 28 which may be gripped to pull the pin 20 out of opening 22 against the force exerted by spring 24.

Each foot pad 14 is thus mounted on its guide bar 16 for sliding movement between the fully retracted position shown for the left foot pad in FIG. 2 and the fully extended position shown for the right foot pad in FIG. 2. In the fully retracted position, the foot pad is directly adjacent the housing 12 to provide for compact storage of the unit. In the fully extended position, the foot pad is spaced well away from the housing 12 in order to accommodate a relatively wide stance of a user of the device. There may be one or more intermediate positions between the fully extended and fully retracted position of each foot pad. It is noted that the extension of the tip of pin 20 through one of openings 22 latches the foot pad in position, and the foot pad remains latched in place until the pin 20 is intentionally retracted and the foot pad is adjusted in or out.

Figure 8:
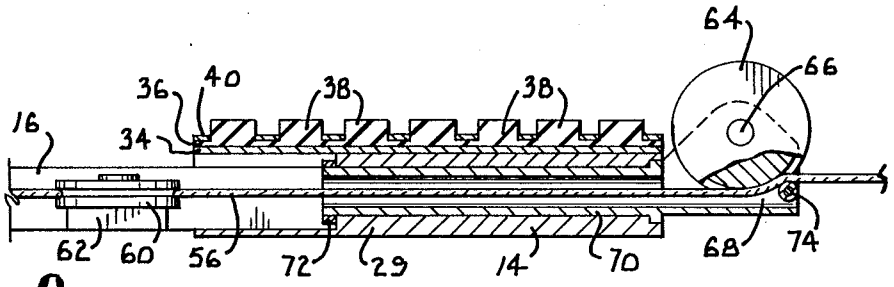
FIG. 8 is a fragmentary sectional view on an enlarged scale taken generally along line 8—8 of FIG. 5 in the direction of the arrows.
Figure 7:
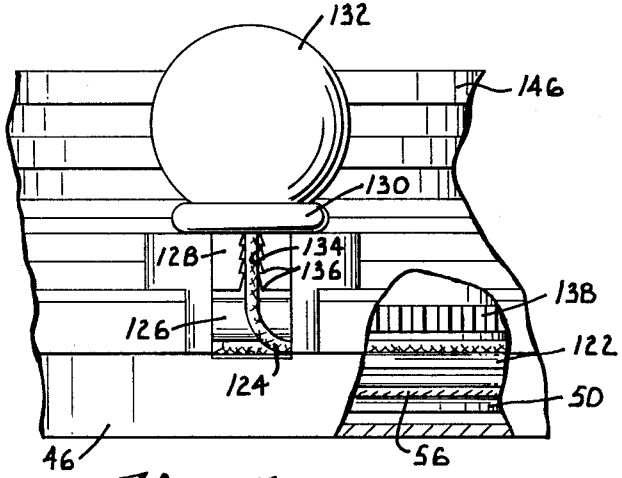
FIG. 7 is a fragmentary front end elevational view taken generally along line 7—7 of FIG. 6 in the direction of the arrows, with a portion broken away for purposes of illustration.

Each foot pad 14 has a size and shape to receive the foot of a user of the exercise device on the upper surface of the foot pad. As best shown in FIG. 8, each foot pad has a flat bottom plate 29 which normally rests on the floor. A curved wall 30 (see FIGS. 1 and 2) extends upwardly from the periphery of the bottom plate 29 and is reinforced by a plurality of internal partitions 32. Referring again to FIG. 8, a plastic or aluminum plate 34 covers the top of each foot pad 14 and rests on the top edge of the wall 30. A rubber mat 36 is glued or otherwise secured to the upper surface of plate 34 and includes a plurality of upwardly projecting pads or buttons 38. An apertured plate 40 which may be constructed of aluminum or another metal is secured on top of the rubber mat 36 with the buttons 38 projecting upwardly through round openings in the plate 40. The rubber pads or buttons 38 provide a high friction surface for contact with the feet of the user to prevent the feet from slipping during use of the device.

Figure 6:
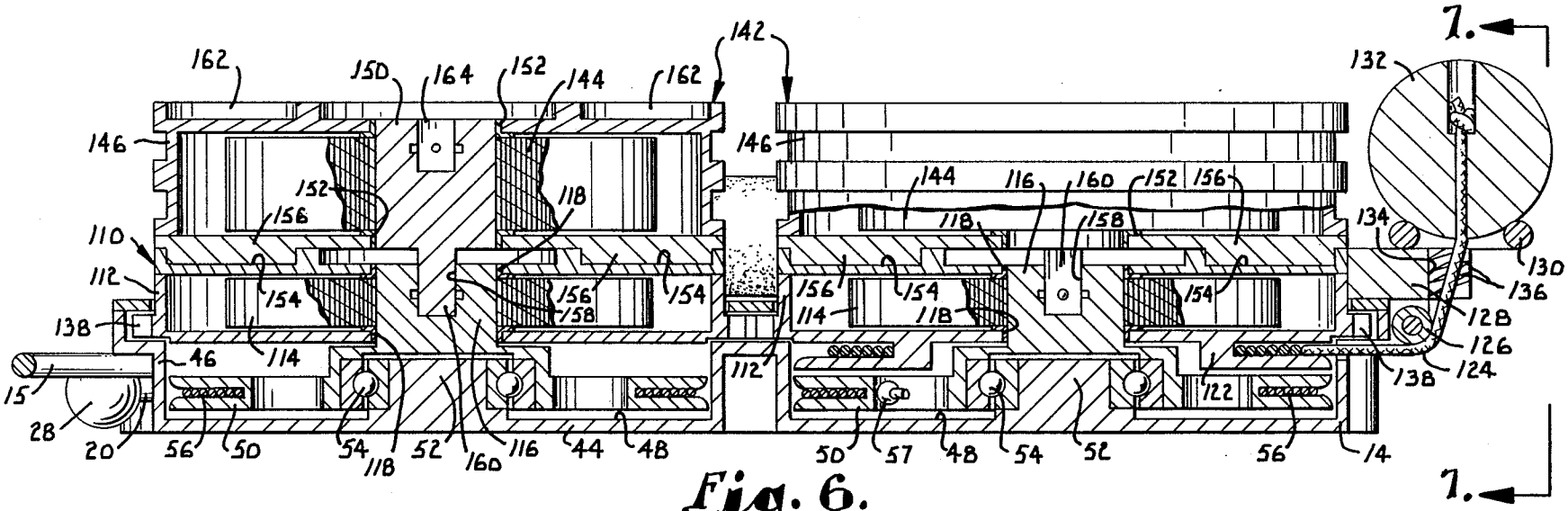
FIG. 6 is a fragmentary sectional view on an enlarged scale taken generally along line 6—6 of FIG. 4 in the direction of the arrows.

As best shown in FIG. 6, the central housing includes a flat base plate 44 and a curved wall 46 which extends upwardly from the periphery of the base plate 44. Within the wall 46, the housing 12 provides a pair of separate compartments 48 which are generally circular and located one behind the other. Each compartment 48 is provided with a take up reel 50 which is mounted for rotation on a short post 52 which provides a vertical axis about which the reel 50 can turn. Bearings 54 support the reels 50 for rotation on the posts 52. A flexible cord 56 is wound around each reel 50 and is secured to the reel at one end 57.

The two reels 50 and their respective cables 56 operate independently of each other. As best shown in FIG. 5, the reel 50 located near the back of the device 10 is dedicated to the right side of the device, while the other or forward reel 50 is dedicated to the left side of the device. The cords 56 are drawn around respective idler pulleys 58 mounted for rotation in housing 12 near its opposite sides. The cords are drawn around additional idler pulleys 60 which are mounted for rotation on brackets 62 extending from the forward guide bars 16. The cables 56 then extend through the respective foot pads 14 on the opposite sides of the device and are drawn around pulleys 64 mounted on the outer sides of the foot pads 14. As best shown in FIG. 8, each pulley 64 is mounted to rotate on a pin 66 carried on a U-shaped pulley bracket 68. Each pulley bracket 68 is in turn carried on the outer end of a hollow pin 70 which is supported on the corresponding foot pad 14 to pivot about a horizontal axis which is perpendicular to the rotational axis provided by the pin 66. A retainer ring 72 retains pin 70 on the foot pad.

In this manner, each pulley bracket 68 can swivel about the horizontal axis provided by pin 70, and the pulley 64 can rotate about pin 66. The cord 56 is extended through the hollow pin 70 and is engaged between pulley 64 and a small roller 74 (see FIG. 8) mounted on the pulley bracket slightly below the pulley. The swiveling action provided by the pulley brackets 68 allows the cords 56 to extend at various angles toward the front and back of the device, as well as straight up.

Figure 10:
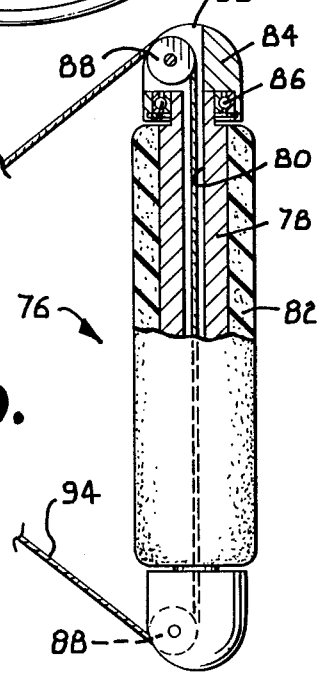
FIG. 10 is a fragmentary top plan view on an enlarged scale taken generally along line 10—10 of FIG. 3 in the direction of the arrows, with a portion shown in section for purposes of illustration.

The outer end of each cord 56 carries a hand grip which is generally identified by numeral 76. Each hand grip 76 is specially constructed in the manner shown in FIG. 10. An aluminum handle 78 is provided with central longitudinal passage 80 and receives a sleeve 82 which is constructed of neoprene rubber or a similar material providing a good cushioning grip for the hand. Each handle 78 has a pair of end caps 84 mounted to rotate about the longitudinal axis of the handle by bearings 86. A pulley 88 is mounted to rotate on each end cap 84 in a small slot 90 which connects with the passage 80 in the handle 78

Figure 1:
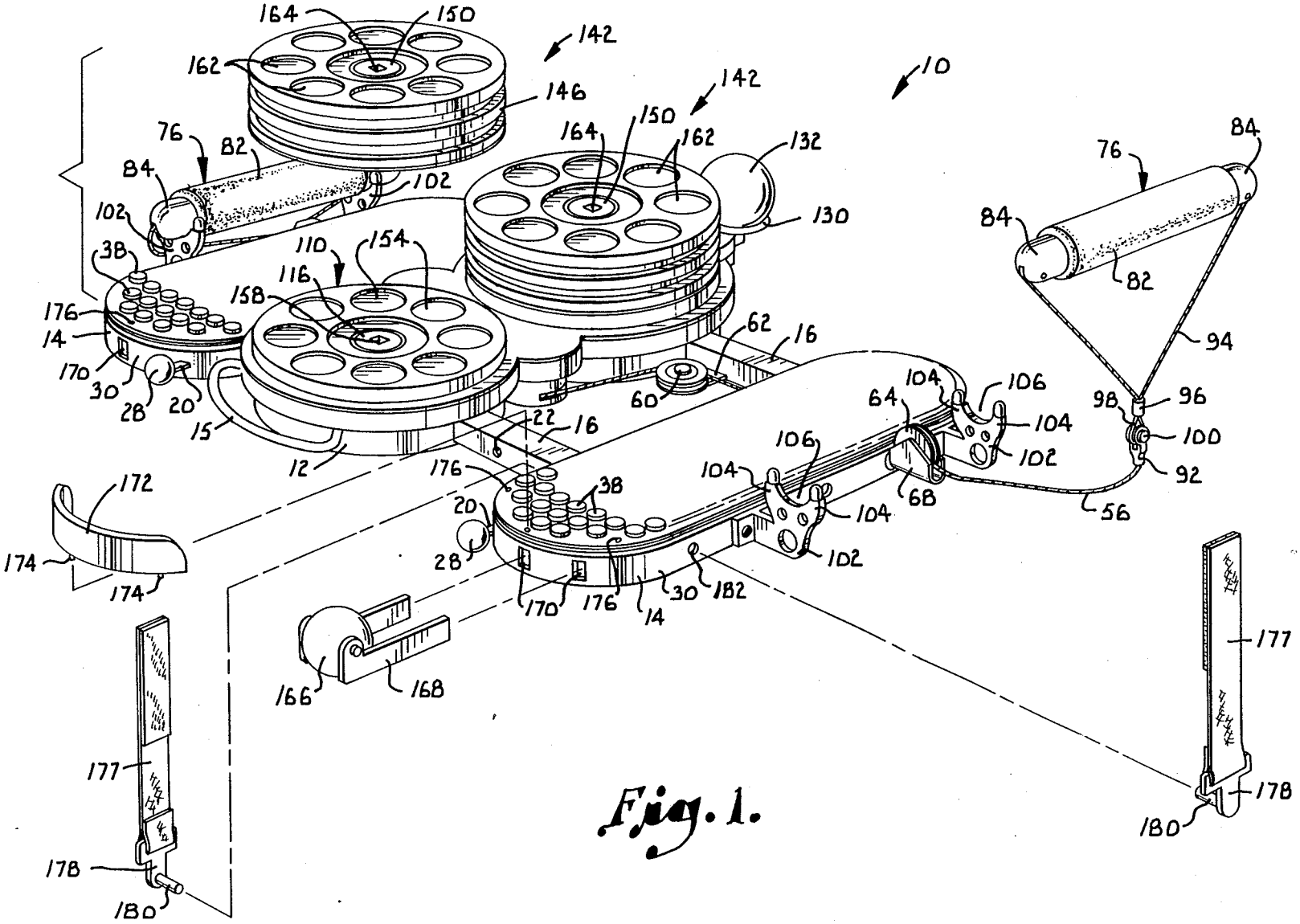
FIG. 1 is a perspective view of a portable exercise device constructed according to a preferred embodiment of the present invention, with certain components depicted in exploded fashions.
Figure 3:
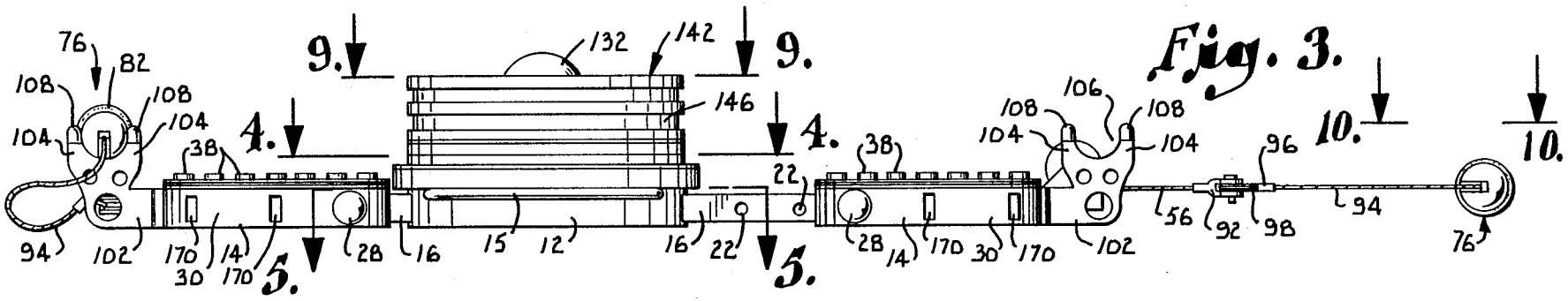
FIG. 3 is a rear elevational view of the exercise device, with one of the hand grips in place on its cradle and the other hand grip removed from its cradle.

Referring additionally to FIGS. 1–3, a clevis 92 is crimped on the end of each cord 56. A flexible cord is formed in a loop 94 and extends in a triangular shape around both of the pulleys 88 and through the passage 80 in the handle. A ferrule 96 is crimped onto each loop 94 to provide a small eye 98 which is pinned at 100 to the clevis 92 in order to connect the hand grip 76 on the cord 56. The pin 100 can be removed in order to detach the hand grip 76 from its cord 56.

By virtue of this construction of the hand grips and their manner of attachment to the cords 56 the pulleys 88 can travel along the cord loop 94 to accommodate skewing of the handle during the performance of exercise routines. Additionally, the end caps 84 can turn on the handle 78. This construction thus provides great flexibility and allows the wrists and arms to flex, bend and turn as the device is used.

Each hand grip 76 is provided with a cradle on which the hand grip rests when not in use. The cradle for each hand grip includes a pair of forked brackets 102 which are mounted to the outer side of the corresponding foot pad 14. As best shown in FIG. 3, each bracket 102 includes a pair of spaced apart fingers 104 which present a semi-circular notch 106 between them. The tips of the fingers 104 are provided with caps 108 which are constructed of rubber or a similar material. The spacing between the brackets 102 in each pair is such that the end caps 84 of the corresponding hand grip 76 can be fitted in the notches 106. The fit of the end caps is rather tight so that the rubber caps 108 firmly grip the hand grip in order to retain it in place in the cradle until it is intentionally pulled out of the cradle.

Each of the take up reels 50 is provided with its own independent resistance system, and the resistance system for each take up reel includes a built-in spring pack which is generally identified by numeral 110. Each spring pack 110 includes a circular case 112 which contains a clock-type spring 114 taking the form of a band arranged in a coil. The case 112 is fitted on a vertical shaft 116 (FIG. 6) which projects upwardly from the center of the underlying reel 50. The case 112 can turn about the axis of the shaft 116, with nylon bushings 118 being provided to accommodate the relative rotation.

Figure 4:
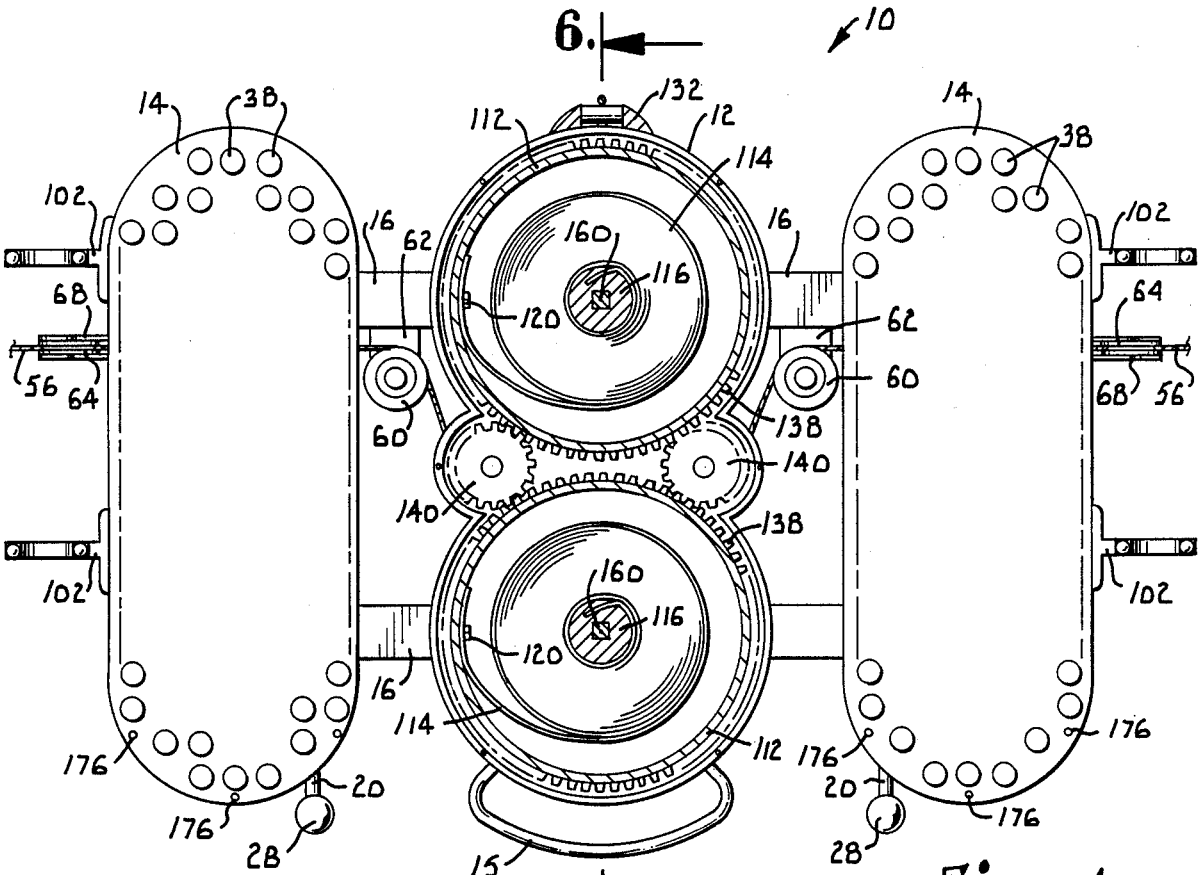
FIG. 4 is fragmentary sectional view taken generally along line 4—4 of FIG. 3 in the direction of the arrows.

As best shown in FIG. 4, the inside end of each spring 114 is secured to the corresponding shaft 116 while the outside end of each spring 114 is secured to its case 112 by a screw 120 or other fastener. The front spring pack 110 is provided on its bottom plate with a reel or spool 122 (FIG. 6) which forms part of a tension adjustment mechanism used to adjust the spring force applied to each of the reels 50. A flexible cable 124 is wound on and secured to the spool 122 at one end. Cable 124 extends out through the front of the housing and around a roller 126 mounted a block 128 which is secured to the front of the housing. Also mounted on the block 128 is a ring 130 which forms a seat for a ball 132 secured to the end of the cable 124. The cable 124 is passed through the ring 130 and also through a V-shaped notch 134 formed on the front of the block 128. The sides of the notch 134 are provided with teeth 136 which can bite into and thus grip the cable 124.

Each spring pack 110 is provided with a gear wheel 138. Referring to FIG. 4 in particular, the teeth of the two gear wheels 138 mesh with the teeth of a pair of small idler gears 140 which are mounted for rotation about vertical axes in the housing 12. The two spring packs 112 are thus connected by the gear mechanism in a manner causing them to rotate in the same direction and to the same extent. As an alternative to the gear mechanism, other mechanisms such as chains, belts and the like can be provided to adjust each spring pack simultaneously.

When the tension adjustment cable 124 is pulled to unwind it from the spool 122 the spool and the connected spring pack case 112 rotate in a direction causing the spring 114 to apply increased force on its take up reel 50. By virtue of the gear mechanism which connects the two spring packs 110, both spring packs are rotated in the same direction and to the same extent so that both springs 114 apply increased force to their take up reels 50. In this manner, the forces applied to the reels 50 when the cords 56 are fully retracted, can be adjusted. When the tension adjustment cable 124 has been extended to the desired position, the cable 124 can be wedged into the notch 134 such that it is gripped and held in place by the teeth 136. This secures the cases 112 of the spring packs in place and thus sets the spring force that must be overcome in order to pull the cords 56 from their fully retracted positions.

Figure 9:
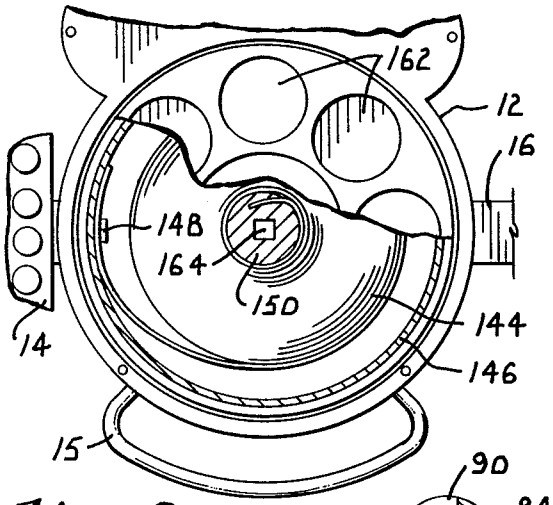
FIG. 9 is a fragmentary plan view taken generally along line 9—9 of FIG. 3 in the direction of the arrows, with a portion broken away for purposes of illustration.

The spring resistance system is specially constructed so that the resistance force can be increased or decreased. This is accomplished by providing additional spring packs such as those generally identified by numeral 142. The additional spring packs 142 are constructed generally similar to the built-in spring packs 112, in that each spring pack 142 includes a clock-type band spring 144 which is arranged in a coil within a circular case 146. The outer end of spring 144 is secured to the case 146 by a screw 148 (see FIG. 9) or another fastener. The inner end of spring 144 is secured to a shaft 150 which forms part of the spring pack 142. The case 146 is supported to rotate on the shaft 150 by suitable bushings 152 (see FIG. 6).

The spring packs 112 and 146, have the same circumference and are arranged to be stacked on one another to increase the spring resistance force. The top plate of each spring pack 112 is provided with a plurality of circular depressions 154 which are arranged in a circular pattern about the shaft 116. The bottom plate of each removable spring pack 142 is provided with a plurality of projecting buttons 156 which are located and arranged to fit closely in the depressions 154 when the spring pack 142 is stacked on top of spring pack 110. The fit of the buttons 156 in the depressions 154 connects the cases 112 and 146 of the stacked spring packs together.

Each of the shafts 116 is provided with a central passage 158 which may be square in cross section. A square pin 160 projects downwardly from the shaft 150 of each spring pack 142. The pins 160 fit closely in the respective passages 158 in order to connect the shafts 150 with the respective shafts 116 and the corresponding take up reels 50 when the spring packs are stacked on one another.

As best shown in FIG. 6, the added spring packs 142 are considerably thicker than the built-in spring packs 110, and the springs 144 may be approximately twice as wide as the springs 114. Consequently, the added spring packs 142 each provides approximately twice the resistive spring force as each built-in spring packs 110. However, it is noted that the springs in the built-in spring packs and the added spring packs may be of various sizes, or they may all be the same size. In any event, each added spring pack has a plurality of circular depressions 162 and its shaft 150 has a square passage 164 so that one or more additional spring packs may be stacked on top of it. It is also noted that the spring pack 142 and any additional spring packs that are stacked on it may be quickly and easily added to or removed from the stack.

In use, the two foot pads 14 are first adjusted on the bars 16 to the proper positions to accommodate the stance of the user of the exercise device. Relatively tall persons should have a relatively wide stance, and the foot pads should then be adjusted to the fully extended positions to provide the widest stance. Shorter persons may want to adjust the foot pads to an intermediate position or even to a fully retracted position.

If resistance in addition to that afforded by the built-in spring packs 110 is desired added spring packs 142 of the desired size and number are stacked on top of the built-in spring packs 110. With the user standing on the foot pads 14, ball 132 may then be gripped and pulled outwardly to extend the cord 124 until the desired initial resistance is present. Once the cable 124 is extended to the desired length, it is wedged into the notch 134 so that the teeth 136 grip it in order to maintain the cable in place to set the initial spring resistance. The ball 132 may then be placed on its seat ring 130.

The tension adjustment mechanism provides a rather wide variation in the spring force that must be overcome in order to initially extend the cords 56. For example, with only the built-in spring packs 110 present and the springs 114 having a width of approximately one-half inch, the spring force applied to each take up reel 50 may be approximately 2.5 pounds with the adjustment cable 124 fully retracted. With the cable 124 fully extended, the springs 114 are stressed to an extent that they apply to each reel 50 a force of approximately 25 pounds.

After the tension has been adjusted as desired, the user removes the two hand grips 76 from their cradles. The user can then carry out virtually any free weight exercise. For example, the hand grips can be pulled upwardly to carry out curls, press exercises, stretching exercises, and other exercises that are normally performed during free weight workouts.

As each cord 56 is pulled to unwind it from its take up reel 50 the spring resistance force that is applied to the reel 50 must be overcome. As the cords 56 progressively unwind, the springs 114 (and 144) are placed under increasing stress and thus provide increased resistance within increased extension of the cords. The springs continuously exert a force tending to retract the cords 56. As a result, the user encounters the spring force as the cords 56 are being retracted, as well as when they are being extended. Thus, the exercise device offers substantially the same benefits as free weights which provide beneficial effects during lowering as well as during raising of the weights. The exercise device of the present invention is thus to be contrasted with machines that use braking or friction forces that operate only in one direction; i.e. when the cable is being extended.

At the end of the workout, the hand grips 76 can be replaced in the cradles for storage and the foot pads 14 are preferably moved inwardly to the fully retracted positions. This provides the exercise device with a compact storage position such that it can easily be stored or carried in a brief case, suitcase or bag. The tension adjustment cable 124 should likewise be returned to its fully retracted condition with the ball 132 in place on the seat ring 130. Preferably, the springs 114 are under a small tension with the cords 56 and cable 124 fully retracted. This prevents the cords and cable from having excessive slack which could result in entanglement and other problems.

It is contemplated that the exercise device 10 can be provided with an accessory kit that allows it to be used to conduct rowing exercises. Included in the accessory kit are a pair of rollers 166 (see FIGS. 1 and 11) each mounted for rotation on a bracket, 168. The back edge of each foot pad 14 is provided with a pair of openings 170 for receiving the legs of the corresponding bracket 168. The brackets 168 may have a press fit in the openings 170 or they may be detachably secured in some other fashion. Also included are a pair of curved heel cups 172 having downwardly projecting pegs 174. The pegs 174 may be fitted in openings 176 formed in the top plates of the foot pads 14.

Figure 11:
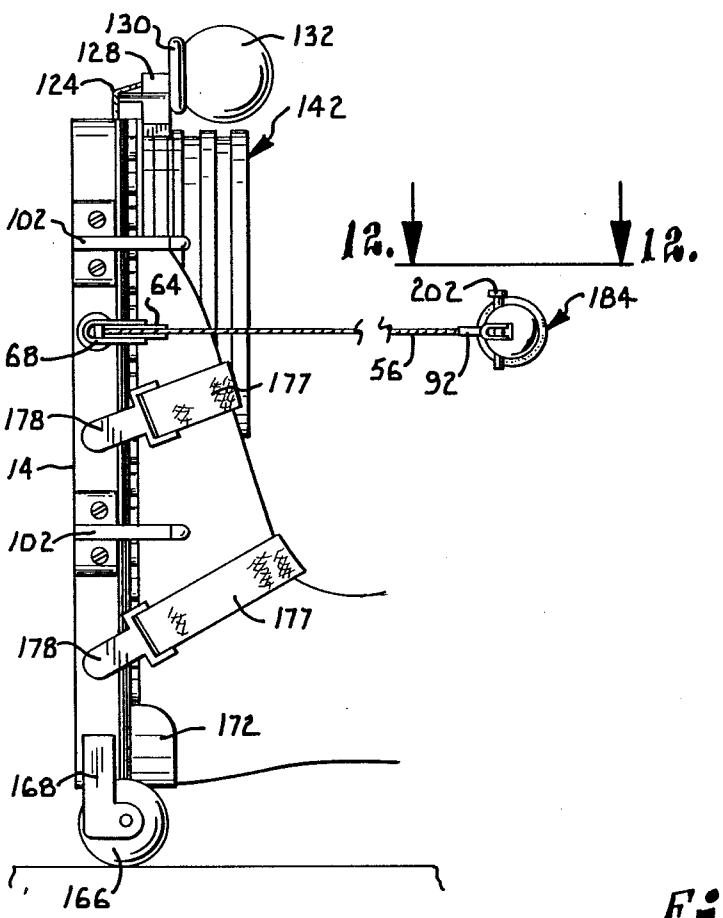
FIG. 11 is a side elevational view showing the exercise device in use to perform rowing exercises, with the break lines indicating continuous length.

A plurality of foot straps 177 are also provided for each foot pad 14. Each strap 177 is mounted on a bracket 178 having a projecting peg 180 that may be press fit in a corresponding opening 182 in one side of the foot pad 14. As shown in FIG. 11, each foot pad 14 preferably has two sets of mating straps 177 near the front and back. Mating hook and loop type fasteners or other fastening means may be provided to detachably connect the mating straps.

Figure 12:
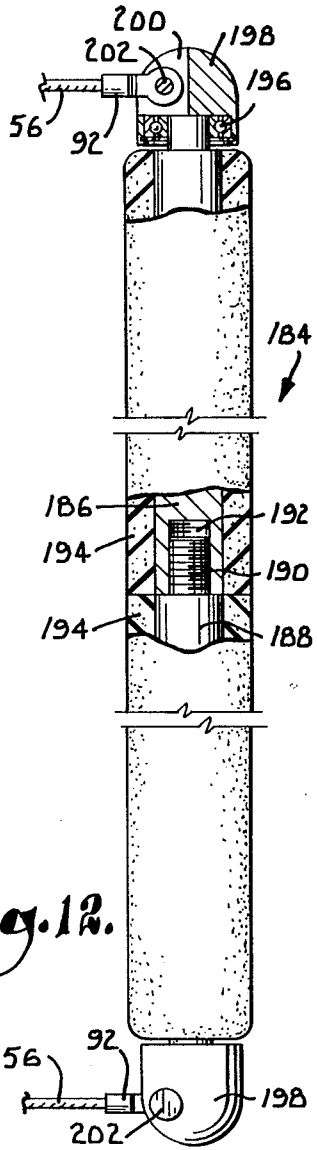
FIG. 12 is a fragmentary top plan view on an enlarged scale taken generally along line 12—12 of FIG. 11 in the direction of the arrows, with portions shown in section for purposes of illustration and the break lines indicating continuous length.

The rowing accessory kit also includes a rowing bar 184 which is best shown in FIG. 12. The rowing bar 184 includes a pair of elongate handle sections 186 and 188 which may be connected end to end. The connections is provided by a threaded stud 190 projecting from the end of one handle section which may be threaded into an internally threaded passage 192 formed in the end of the other handle section. Sleeved over each handle section 186 and 188 is a grip 194 which may be constructed of rubber or another substance which may be easily gripped with the hands. Bearings 196 rotatably mount end caps 198 on the outer ends of the handle sections 186 and 188. Each end cap 198 has a slot 200 large enough to receive the clevis 92 which is crimped onto the end of cord 56. A removable pin 202 is used to pin the clevis 92 within the slot 200.

When the device 10 is to be used in rowing exercises, the brackets 168 are applied to the openings 170 in order to mount wheels 166 on the back edges of the foot pads 14. The heel cups 172 are likewise applied to the foot pads, as are the straps 176. The rowing bar 184 is applied by removing the pins 100 to detach hand grip 76. The clevises 92 are then inserted into the slots 200 in the two end caps 198 of the rowing bar and are secured by the pivot pins 202.

In order to use the exercise device to conduct rowing exercises, the user is seated on the floor, and the straps are applied to the feet in the manner shown in FIG. 12, with the heels received by the heel cups 172. The exercise device 10 is then positioned on edge with the rollers 166 engaging the floor so that the device can roll along the floor. Rowing exercises are conducted by grasping the rowing bar 184 in both hands and extending and retracting the legs in order to roll the exercise device away while pulling the arms in toward the user and vice versa. The force applied by the spring packs must be overcome in order to extend the legs, and the spring force is likewise applied as the legs are being bent or retracted during the return stroke.

It should be noted that during free weight workouts, the rowing bar 184 can be used in place of the two hand grips 76 and the bar 184 can then be raised to simulate a typical press exercise of the type carried out in weight lifting. The provision of multiple spring packs that can be stacked to add spring resistance allows the device to offer considerable force opposing extension of the cords.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. An exercising device comprising:

a portable base adapted to rest on a support surface and providing a pair of spaced apart foot pads for receiving the feet of the user;

a pair of reels supported for rotation on the base independently of one another, each reel being rotatable about a rotational axis oriented substantially perpendicular to said foot receiving surfaces;

a pair of flexible lines wound around the respective reels in a manner to rotate the reels when the respective lines are pulled;

a hand grip on each line, said hand grips being situated on opposite sides of said base at locations accessible to the hands of a user standing on said foot pads; and resilient resistance means for each reel acting thereon in a manner to resist rotation of the reel in a direction caused by pulling on the corresponding line, the resilient resistance means for each reel acting independently of the resilient resistance means for the other reel.

2. The exercise device of claim 1 wherein:

said base includes a housing between said foot pads presenting a pair of compartments; and said reels are mounted in the respective compartments.

3. The exercise device of claim 2, including:

a plurality of guide bars projecting from said housing in opposite direction;

a plurality of passages in each foot pad in which said guide bars fit in a manner permitting the foot pads to slide along the guide bars toward and away from one another; and releasable means for latching the foot pads to the guide bars at a plurality of different locations thereon.

4. The exercise device of claim 1, wherein said resistance means comprises a resistance pack for each reel having a resilient resistance element connected with the reel to resist rotation of the reel.

5. The exercise device of claim 4, including:

a wheel on each resistance pack, said wheels being supported for rotation on the base and being coupled together to rotate in unison to effect adjustment of the resistance force exerted by each resistance element on the corresponding reel;

a resistance adjustment spool connected with one of the wheels to effect turning of both wheels when said spool is turned;

a flexible cable wound on said spool for effecting rotation of the spool when said cable is pulled;

a handle on said cable; and releaseable means for gripping said cable in a manner to lock the cable, thereby setting the tension applied to said reels by the resistance elements. away from one another; and releasable means for latching the foot pads to the guide bars at a plurality of different locations thereon.

6. The exercise device of claim 1, wherein each foot pad comprises a rigid plate and a plurality of friction pads projecting above said plate.

7. The exercise device of claim 1, including cradle means on each foot pad for receiving and gripping the corresponding hand grip when not in use.

8. The exercise device of claim 1, including:

an outer side of each foot pad;

a pulley bracket mounted on the outer side of each foot pad for pivotal movement about a substantially horizontal pivot axis; and a pulley on each pulley bracket around which the corresponding line is drawn, each pulley being mounted to turn about a rotational axis oriented substantially perpendicular to the pivot axis of the corresponding pulley bracket.

9. The exercise device of claim 1, wherein:

each hand grip comprises a handle having opposite ends and a longitudinal passage;

each end of the handle has a rotatable pulley thereon; and each line has a loop, said loops being drawn around the pulleys and through the longitudinal passages of the respective handles.

10. The exercise device of claim 9, including:

a cap on each end of each handle; said caps carrying the respective pulleys thereon; and means for mounting said caps for turning movement on the handles.

11. The exercise device of claim 1, including:

a roller on each foot pad at a location to engage the support surface when the base is positioned with the foot receiving surfaces of the foot pads oriented generally vertically and the user seated on the support surface, said rollers being disengaged from the support surface when the base rests thereon with the foot receiving surfaces oriented generally horizontally; and strap means on said foot pads for strapping the feet of the user to the foot pads, thereby allowing the user to exercise in a rowing motion with the lines extending as the base rolls away from the user and retracting as the base rolls toward the user.

12. The exercise device of claim 11, including:

means for establishing a detachable connection of said hand grips with the respective lines;

a rowing bar having opposite ends and a length to be gripped by both hands of a user exercising in a rowing motion; and means for establishing a detachable connection of said lines with the respective opposite ends of said rowing bar.

13. The exercise device of claim 1, wherein said resistance means comprises:

a plurality of resistance packs for each reel each having a resilient resistance element for applying a resistance force resisting rotation of the corresponding reel;

said resistance packs being arranged for detachable stacking on one another and being connected when stacked to apply to the corresponding reel a resistance force which equals the additive resistance forces of the resistance peaks in the stack, thereby permitting variation of the resistive force which must be overcome to pull each line.

14. An exercise device comprising:

a portable base including a housing and a pair of foot pads on opposite sides of said housing presenting foot receiving surfaces for receiving the feet of a user;

a pair of flexible lines each carrying a hand grip, said lines extending from said housing and through the respective foot pads to situate said hand grips adjacent the respective foot pads at locations accessible to a user standing on the foot receiving surfaces of the foot pads;

take up reel means in said housing supported for rotation therein about a rotational axis oriented substantially perpendicular to said foot receiving surfaces, said lines being wound around said reel means to effect rotation thereof when said lines are pulled;

a resistance pack carrying a resilient resistance element; and means for establishing a detachable connection of said resistance pack with said reel means effective to resist rotation of said reel means in a direction caused by pulling of said lines.

15. The exercise device of claim 14, including:

an outer side of each foot pad;

a first pulley for each foot pad mounted for rotation at a location between said housing and the corresponding foot pad; and a second pulley for each foot pad mounted for rotation on the outer side of the corresponding foot pad, said lines being drawn around the first and second pulleys for the respective foot pads.

16. The exercise device of claim 15, including:

a pulley bracket for each of said second pulleys, said second pulleys being mounted on the respective pulley brackets for rotation about axis; and means for mounting said pulley brackets on the outer sides of the respective foot pads for pivotal movement about pivot axes oriented substantially perpendicular to the respective rotational axes.

17. The exercise device of claim 14, including:

a plurality of additional resistance packs each carrying a resilient resistance element therein;

said additional resistance packs being arranged to be stacked on the first mentioned resistance pack one at a time and being connected when stacked thereon to apply to said reel means a resistance force equal to the additive resistance forces of the resistance elements of the resistance packs in the stack.

18. A portable exercise device comprising:

a portable base including a housing and a pair of foot pads on opposite sides of the housing for receiving the feet of a user, said housing presenting a pair of compartments therein;

a reel in each of said compartments supported for rotation therein;

a flexible line wound on each reel for rotating the reel when the line is pulled, each line carrying a hand grip with the hand grips being situated at locations accessible to the respective hands of a user standing on said foot pads;

a resistance pack stacked on each reel, each resistance pack including a resilient resistance element connected with the corresponding reel in a manner to resist rotation of the reel caused by pulling on the corresponding line;

a toothed wheel on each resistance pack supported for rotation to adjust the resistance force applied by each resistance element to the corresponding reel;

means for coupling said wheels for rotation simultaneously in the same direction;

means for effecting rotation of one wheel to adjust the resistance force applied to each reel; and releaseable means for locking said wheels against rotation.

19. An exercise device comprising:

a portable base providing a pair of spaced apart foot pads for receiving the feet of the user;

a pair of reels supported for rotation on the base independently of one another;

a pair of flexible lines wound around the respective reels in a manner to rotate the reels when the respective lines are pulled;

a pair of hand grips each comprising a handle having opposite ends and a longitudinal passage;

a rotatable pulley on each end of each handle;

a loop in each line, said loops being drawn around the pulleys and through the longitudinal passages of the respective handles to mount the hand grips on the respective lines on opposite sides of said base at locations accessible to the hands of a user standing on the foot pads; and resilient resistance means for each reel acting thereon in a manner to resist rotation of the reel in a direction cause by pulling on the corresponding line, the spring resistance means for the other reel.

20. An exercise device comprising:

a portable base providing a pair of spaced apart foot pads for receiving the feet of the user;

a pair of reels supported for rotation on the base independently of one another;

a pair of flexible lines wound around the respective reels in a manner to rotate the reels when the respective lines are pulled;

a hand grip on each line, said hand grips being situated on opposite sides of the said base at locations accessible to the hands of a user standing on said foot pads; and a plurality of resistance packs for each reel, each having a resilient resistance element for applying a resistance force resisting rotation of the reel in a direction caused by pulling on the corresponding line, said resistance packs being arranged for detachable stacking on one another and being connected when stacked to apply to the corresponding reel a resistance force which equals the additive resistance forces of the resistance packs in the stack, thereby permitting variation of the resistive force which must be overcome to pull each line.

21. The exercise device of claim 1, including:

means for establishing a detachable connection of said hand grips with the respective lines;

an elongate bar having opposite ends and a length to be gripped by both hands of a user; and means for establishing a detachable connection of said lines with the respective opposite ends of said bar.

* * * * *